US005625187A

United States Patent [19]

Siems et al.

[11] Patent Number: 5,625,187

[45] Date of Patent: Apr. 29, 1997

[54] APPARATUS FOR MEASURING THE DENSITY OF ACCUMULATIONS OF FIBROUS MATERIAL IN MULTIPLE ROD MAKING MACHINES OF THE TOBACCO PROCESSING INDUSTRY

[75] Inventors: Wolfgang Siems, Hamburg; Erwin Schmalfeld, Reinbek; Elke Köhler, Flensburg, all of Germany

[73] Assignee: Hauni Maschinenbau AG, Hamburg, Germany

[21] Appl. No.: 580,945

[22] Filed: Dec. 29, 1995

[30] Foreign Application Priority Data

Feb. 8, 1995 [DE] Germany ..... 195 04 027.9

[51] Int. Cl.[6] ..... G01N 23/08

[52] U.S. Cl. ..... 250/308; 250/252.1; 250/360.1

[58] Field of Search ..... 250/308, 252.1, 250/360.1

[56] References Cited

U.S. PATENT DOCUMENTS 4,424,443 1/1984 Reuland .
4,703,764 11/1987 Marquardt et al. .
4,865,054 9/1989 Lorenzen et al. ..... 131/280
4,889,138 12/1989 Heitmann et al. .
4,893,640 1/1990 Heitmann et al. .
4,924,885 5/1990 Heitmann et al. .
5,009,238 4/1991 Heitmann .
5,072,741 12/1991 Heitmann .
5,125,419 6/1992 Heitmann .
5,510,616 4/1996 Seymore et al. ..... 250/308

*Primary Examiner*—David P. Porta
*Assistant Examiner*—Richard Hanig
*Attorney, Agent, or Firm*—Darby & Darby

[57] ABSTRACT

Two parallel cigarette rods are guided in a twin cigarette rod making machine between two stationary ionization chambers of a density measuring apparatus. Two radiation sources are mounted on a carrier between the two rods for movement with the carrier between a first position in which the radiation issuing from the sources penetrates through the adjacent rods and into the respective ionization chambers, and a second position in which the radiation enters the respective chambers by way of passages in the guides for the respective rods.

12 Claims, 2 Drawing Sheets

APPARATUS FOR MEASURING THE DENSITY OF ACCUMULATIONS OF FIBROUS MATERIAL IN MULTIPLE ROD MAKING MACHINES OF THE TOBACCO PROCESSING INDUSTRY

BACKGROUND OF THE INVENTION

The invention relates to improvements in apparatus for measuring the density of accumulations of fibrous material (such as tobacco or filter material) in rod making machines of the tobacco processing industry. More particularly, the invention relates to improvements in density measuring apparatus which can be utilized in machines for the simultaneous making of several rod-like accumulations of particulate materials of the type being processed in the cigarette making, cigar making and related industries.

It is already known to construct a density measuring apparatus for use in machines for simultaneous production of two tobacco-containing rods in such a way that radiation issuing from a source is caused to penetrate through moving rods of particulate tobacco and into an ionization chamber, thereupon directly into the ionization chamber, again through the moving rods, and so forth. Reference may be had, for example, to U.S. Pat. No. 4,424,443 the disclosure of which is incorporated by reference. By alternatingly directing radiation through the rods of particulate material and directly into the ionization chamber, the patented apparatus reduces the likelihood of inaccurate density measurements, e.g., due to drift. In other words, such apparatus is designed for automatic calibration in the course of the actual density measuring operation. The signals denoting the actual density include those signals (measurement signals) generated as a result of penetration of radiation through the rods and into the ionization chamber as well as those signals (reference signals) which are obtained in response to direct penetration of radiation into the ionization chamber, i.e., without passing through the rods of particulate material).

OBJECTS OF THE INVENTION

An object of the invention is to provide a novel and improved apparatus for monitoring the characteristics of plural accumulations of particulate material of the type processed in the making of cigarettes, cigars, cigarillos, filter rod sections and the like.

Another object of the invention is to provide a novel and improved apparatus for simultaneously ascertaining the density of plural rod-like accumulations of tobacco or other particulate materials of the type being manipulated in the tobacco processing industries.

A further object of the invention is to provide a density measuring apparatus which can be incorporated into machines of the tobacco processing industry known as multiple rod making machines.

An additional object of the invention is to provide a simple, compact and inexpensive density measuring apparatus which can be incorporated with advantage in existing multiple rod making machines of the tobacco processing industry.

Still another object of the invention is to provide the apparatus with novel and improved means for moving certain constituents between a plurality of different positions.

A further object of the invention is to provide a density measuring apparatus which constitutes an improvement over and a further development of apparatus of the type disclosed in U.S. Pat. No. 4,424,443.

An additional object of the invention is to provide a novel and improved method of automatically calibrating an apparatus for simultaneously measuring the density of plural accumulations of tobacco or other particulate materials for use in the tobacco processing industry.

SUMMARY OF THE INVENTION

The invention is embodied in an apparatus for measuring the density of plural elongated rods (such as cigarette rods) which contain tobacco and/or other particulate material of the tobacco processing industry and are advanced lengthwise along predetermined paths. The improved apparatus comprises an ionization chamber for each of the rods and such chambers are adjacent the respective paths, and the apparatus further comprises a radiation source for each of the rods. Still further, the apparatus comprises a common carrier for the sources and such carrier is movable between a first position in which radiation issuing from the sources penetrates across the respective paths (i.e., across the rods in such paths)and enters the respective chambers, and a second position in which the radiation issuing from the radiation sources enters the respective ionization chambers while bypassing the respective paths (i.e., without penetrating through the respective rods).

In accordance with a presently preferred embodiment, the apparatus comprises two ionization chambers and two radiation sources. The two ionization chambers are spaced apart from each other and are or can be at least substantially mirror images of each other with reference to a plane which is disposed between the two chambers. Furthermore, the two radiation sources, too, are or can be at least substantial mirror images of one another with reference to such plane.

The paths include or can include first and second elongated paths, and the carrier is or can be disposed between, and is or can be movable with the radiation sources at least substantially transversely of, the first and second paths.

In a presently preferred embodiment of the improved apparatus, the paths include first and second paths and the apparatus further includes first and second guides for rods in the first and second paths. The ionization chambers include first and second chambers which are respectively adjacent the first and second guides and the first and second guides are respectively provided with first and second channels, bores or other suitable passages which communicate with the first and second chambers, respectively. The radiation sources include first and second sources for the rods in the first and second paths, respectively, and the radiation issuing from the first and second sources enters the first and second ionization chambers by way of the passages in the first and second guides, respectively, in the second position of the carrier. The first and second paths are or can be at least substantially parallel to each other and are or can be disposed between the first and second chambers. The carrier is or can be disposed between the first and second paths.

The apparatus further comprises means for moving the carrier between the first and second positions, preferably for periodically moving the carrier between such positions. In a presently preferred embodiment, the moving means comprises means (e.g., at least one coil spring or another suitable resilient element) for permanently biasing the carrier to one of the first and second positions. The arrangement can be such that the moving means comprises resilient means for urging the carrier to the second position and fluid-operated (hydraulic or pneumatic) means for moving the carrier to the first position.

The aforementioned guides which define the paths for the plural rods can form part of a multiple-rod cigarette making machine.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
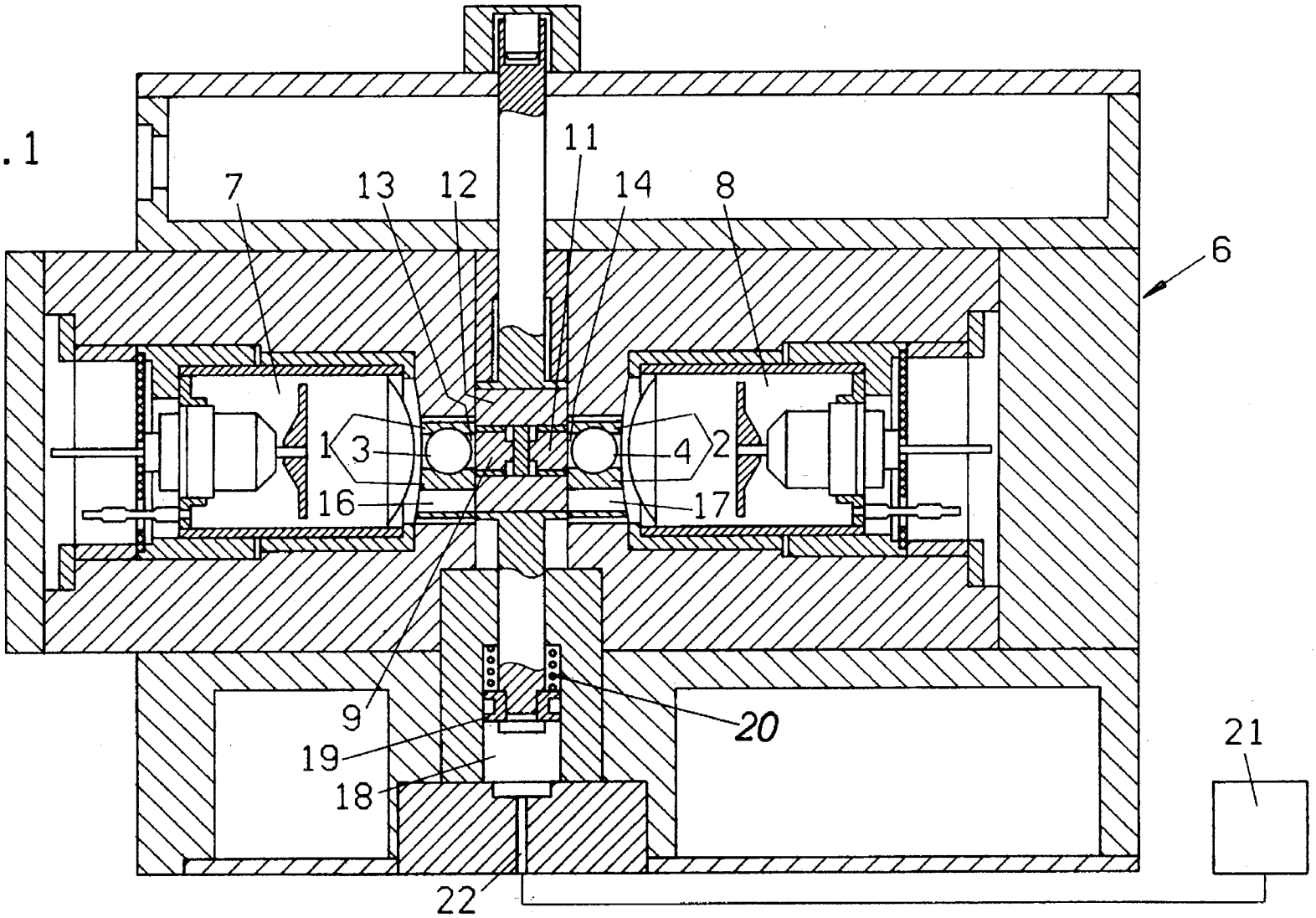
FIG. 1 is a transverse sectional view of an apparatus with two ionization chambers and two radiation sources, the common carrier for the two radiation sources being shown in its first position.
Figure 2:
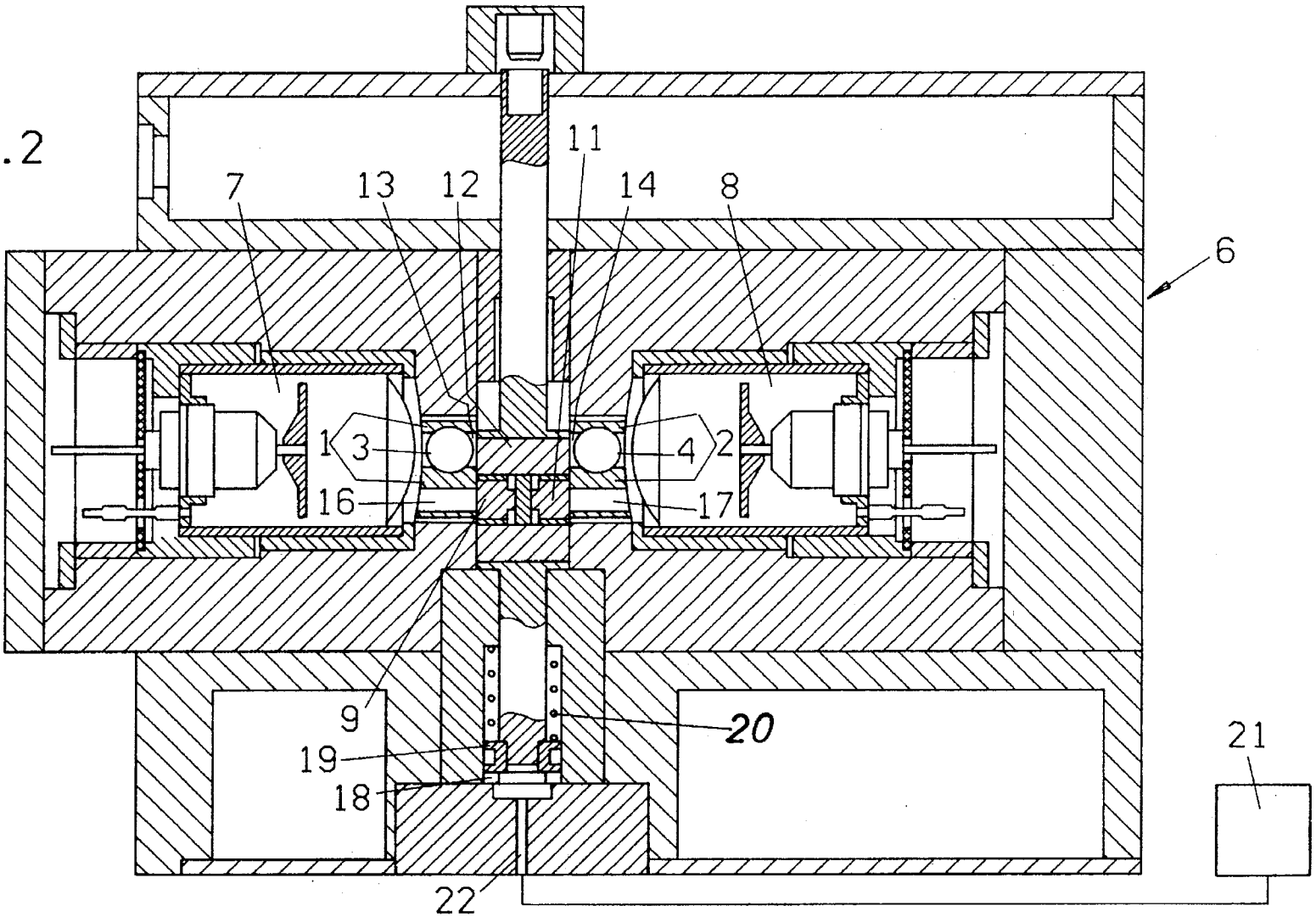
FIG. 2 illustrates the structure of FIG. 1 but with the carrier shown in the second position.

The apparatus which is shown in FIGS. 1 and 2 is designed for simultaneous measurement of the density of two elongated parallel cigarette rods 3, 4 which are continuously advanced along two elongated parallel paths in a direction at right angles to the planes of the drawings. The two paths are defined by two elongated parallel guides 1, 2 which can form part of a multiple-rod cigarette making machine, e.g., a machine of the type disclosed in commonly owned U.S. Pat. No. 4,889,138 (granted Dec. 26, 1989 to Heitmann et al.) or U.S. 4,893,640 (granted Jan. 16, 1990 to Heitmann et al.) or U.S. 4,924,885 (granted May 15, 1990 to Heitmann et al.) or U.S. 5,009,238 (granted Apr. 23, 1991 to Heitmann) or U.S. 5,072,741 (granted Dec. 17, 1991 to Heitmann) or U.S. 5,125,419 (granted Jun. 30, 1992 to Heitmann). The disclosures of all of the above-enumerated patents are incorporated herein by reference.

The guides 1 and 2 are installed in a housing 6 which further accommodates two ionization chambers 7 and 8 respectively adjacent the paths for the cigarette rods 3, 4 and being at least substantial mirror images of each other with reference to a symmetry plane which is normal to the planes of FIGS. 1 and 2 and is located midway between the guides 1 and 2. The ionization chambers 7, 8 form part of the actual density measuring means, and the latter further comprises two radiation sources 9 and 11 (e.g., in the form of customary radioactive preparations) which are also mirror images of each other with reference to the aforementioned symmetry plane and are mounted in a common carrier or holder 12 between the guides 1 and 2 for the running rods 3, 4, respectively.

The carrier 12 is movable between a first position which is shown in FIG. 1 and a second position which is shown in FIG. 2. Such movements take place transversely of the longitudinal direction of the rods 3, 4 and their respective guides 1, 2, namely vertically as viewed in FIGS. 1 and 2. When the carrier 12 is maintained in the first position of FIG. 1, radiation issuing from the sources 9, 11 is caused to penetrate across the respective rods 3, 4 and into the respective ionization chambers 7 and 8. On the other hand, radiation issuing from the sources 9, 11 bypasses the paths for the rods 3, 4 when the carrier 12 is moved to the second position of FIG. 2 because such radiation is then free to pass through bores, holes or analogous passages 16, 17 respectively provided in the guides 1, 2 and communicating with the internal spaces of the respective ionization chambers 7 and 8. The reference characters 13 and 14 respectively denote density measurement windows which are provided in the guides 1, 2 and through which the radiation penetrates toward and through the rods 3, 4 and thereupon into the adjacent ionization chambers 7, 8 when the carrier 12 is held in the position of FIG. 1. The first position of the carrier 12 (FIG. 1) can be said to constitute a measuring position because the radiation then issuing from the sources 9 and 11 is free to penetrate through the respective windows 13, 14 and thereupon across the respective rods 3 and 4. On the other hand, the second position (FIG. 2) of the carrier 12 can be said to constitute a reference position because the radiation issuing from the sources 9, 11 is then free to bypass the paths for the rods 3, 4 and enters the respective chambers 7, 8 for the purposes of calibrating the density measuring apparatus. The illustrated guides 1, 2 and their passages 16, 17 are also mirror images of each other with reference to the aforementioned symmetry plane between the paths for the rods 3 and 4.

The improved apparatus further comprises means for periodically moving the carrier 12 with the two radiation sources 9 and 11 between the positions of FIGS. 1 and 2. The illustrated moving means comprises a resilient element 20 which is designed and installed to permanently bias the carrier 12 to the second position of FIG. 2 in which the radiation sources 9, 11 are in register with the respective passages 16 and 17. The moving means further comprises a fluid-operated arrangement for moving the carrier 12 to the first position of FIG. 1; such moving arrangement comprises a cylinder chamber 18 in an insert of the housing 6, a source 21 of hydraulic or pneumatic fluid, a conduit 22 which connects the source 21 with the cylinder chamber 18, and a reciprocable piston 19 which is installed in the chamber 18 and mounts the carrier 12. The axis of the piston 19 can be said to be located in the aforementioned symmetry plane. The illustrated resilient element 20 is a coil spring which reacts against and internal shoulder of the aforementioned insert and urges a collar of the piston 19 downwardly toward the position of FIG. 2. The valve or valves which control the flow of pressurized fluid between the source 21 and the cylinder chamber 18 of the moving means for the carrier 12 are of standard design and are not shown in the drawings. For example, the source 21 can contain a supply of compressed air or another suitable gaseous fluid.

An advantage of the resilient element 20 is that it automatically shifts the carrier 12 and the radiation sources 9, 11 to the second or reference positions of FIG. 2 when the aforementioned arrangement (18, 19, 21, 22) for moving the carrier 12 to the first position of FIG. 1 is out of commission.

The aforediscussed mounting of the guides 1, 2, of the ionization chambers 7, 8, of the radiation sources 9, 11 and of the passages 16, 17 in such a way that they are at least substantial mirror images with reference to the aforementioned symmetry plane which is normal to the planes of FIGS. 1, 2 and includes the axis of the piston 19 is particularly advantageous when the apparatus is designed to measure the density of two running rods containing particulate material of the tobacco processing industry. However, the invention can also be embodied, with suitable modifications, in apparatus for simultaneous measurement of the density of more than two rods of particulate material, e.g., four rods.

An important advantage of the improved apparatus is that its constituents occupy a small amount of space in a machine for simultaneous production of two or more elongated rods containing particulate material of the tobacco processing industry. In addition, the aforediscussed periodic movements of the radiation sources 9, 11 between the measuring positions of FIG. 1 and the reference positions of FIG. 2 can be carried out in a simple and reliable manner by resorting to simple, compact and inexpensive but reliable moving means.

The exact construction of the ionization chambers 7, 8 and/or the exact composition of the radioactive preparations constituting the radiation sources 9, 11 forms no part of the present invention. Density measuring means employing an ionization chamber and a radioactive preparation are disclosed, for example, in commonly owned U.S. Pat. No. 4,703,764 granted Nov. 3, 1987 to Marquardt et al. The disclosure of this patent is also incorporated herein by reference.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for measuring the density of plural elongated rods which contain particulate material of the tobacco processing industry and are advanced lengthwise along predetermined paths, comprising an ionization chamber for each of the rods, said chambers being adjacent the respective paths; a radiation source for each of the rods; and a carrier for said sources, said carrier being movable between a first position in which radiation issuing from said sources penetrates across the respective paths and enters the respective chambers and a second position in which the radiation issuing from said sources enters the respective chambers while bypassing the respective paths.

2. The apparatus of claim 1, comprising two ionization chambers and two radiation sources.

3. The apparatus of claim 2, wherein said two ionization chambers are spaced apart from each other and are at least substantially mirror images of each other with reference to a plane disposed between said two ionization chambers.

4. The apparatus of claim 3, wherein said two radiation sources are at least substantially mirror images of each other with reference to said plane.

5. The apparatus of claim 1, wherein said paths include first and second elongated paths and said carrier is disposed between and is movable with said radiation sources at least substantially transversely of said first and second paths.

6. The apparatus of claim 1, wherein said paths include first and second paths and further comprising first and second guides for rods in said first and second paths, said chambers including first and second chambers adjacent said first and second guides and said first and second guides respectively having first and second passages communicating with said first and second chambers, said radiation sources including first and second sources for the rods in said first and second guides, respectively, and the radiation issuing from said first and second sources entering said first and second chambers by way of the passages in said first and second guides, respectively, in the second position of said carrier.

7. The apparatus of claim 6, wherein said first and second paths are at least substantially parallel to each other and are disposed between said first and second chambers, said carrier being disposed between said first and second paths.

8. The apparatus of claim 1, further comprising means for periodically moving said carrier between said first and second positions.

9. The apparatus of claim 8, wherein said moving means comprises means for biasing said carrier to one of said first and second positions.

10. The apparatus of claim 9, wherein said means for biasing comprises at least one resilient element.

11. The apparatus of claim 8, wherein said moving means includes resilient means for urging said carrier to said second position and fluid-operated means for moving said carrier to said first position.

12. The apparatus of claim 1, further comprising a multiple-rod cigarette making machine having guides defining said paths.

* * * * *